US005613878A

United States Patent [19]

Tsuji et al.

[11] Patent Number: 5,613,878

[45] Date of Patent: Mar. 25, 1997

[54] REVERSE INSERTION PREVENTING CONNECTOR

[75] Inventors: Masanori Tsuji; Motohisa Kashiyama, both of Shizuoka, Japan

[73] Assignee: Yazaki Corporation, Tokyo, Japan

[21] Appl. No.: 360,021

[22] Filed: Dec. 20, 1994

[30] Foreign Application Priority Data

Dec. 28, 1993 [JP] Japan ..... 5-336422

[51] Int. Cl.[6] ..... H01R 13/40

[52] U.S. Cl. ..... 439/595; 439/744

[58] Field of Search ..... 439/595, 744

[56] References Cited

U.S. PATENT DOCUMENTS

| | | | |
|---|---|---|---|
| 5,190,477 | 3/1993 | Akeda | 439/595 |
| 5,242,317 | 9/1993 | Watanabe | 439/595 |
| 5,393,248 | 2/1995 | Yagi et al. | 439/595 |

FOREIGN PATENT DOCUMENTS 62-30292 8/1987 Japan .

*Primary Examiner*—P. Austin Bradley
*Assistant Examiner*—Jill DeMello
*Attorney, Agent, or Firm*—Wigman, Cohen, Leitner & Myers, P.C.

[57] ABSTRACT

To improve the insertion workability of a terminal part (29) into a connector housing (25), a reverse insertion preventing connector comprises: a terminal part (29) and a connector housing (25). The connector housing (25) is formed with a flexible engage arm (31) having an arm portion (37) extending from an inner wall (33) thereof, an engage step portion (43) engaged with the terminal part (29) when the terminal part has been inserted into the connector housing (25) in a normal direction, and an arm end projection portion (47) engaged with the terminal part (29) when the terminal part is being inserted into the connector housing (25) in a reverse direction. In particular, the connector housing (25) is further formed with at least one terminal insertion guide slope portion (51) extending from the inner wall (33) thereof to such a position as to be roughly flush with the arm end projection portion (47) beside the flexible engage arm (31) so as to guide the terminal part (29) as it is inserted into the connector housing (25).

8 Claims, 6 Drawing Sheets

REVERSE INSERTION PREVENTING CONNECTOR

BACKGROUND OF THE INVENTION

1. Technical Field

The present invention related to a reverse insertion preventing connector for accommodating a male terminal part to be electrically mated with a female connector, and more specifically to a reverse insertion preventing male connector housing which can prevent the male terminal part from being inserted thereinto in the reverse direction.

2. Description of the Related Art

FIGS. 1, 2, 3A and 3B show a prior art reverse insertion preventing connector 1 disclosed In Japanese Published Unexamined (Kokai) Utility Model No. 62-30292. In FIGS. 1 and 2, the reverse Insertion preventing connector 3 is roughly composed of a connector housing 1 and a terminal part 7. In more detail, the connector housing 3 is formed with a terminal accommodating chamber 5. In this connector housing 3, a flexible engage arm 9 is formed so as to be engaged with the terminal part 7 inserted into the terminal accommodating chamber 5. The flexible engage arm 9 extends from the inner wall 11 of the connector housing 3 toward an opening side thereof so as to form a space between the engage arm 9 and the inner wall 11 in which the engage arm 9 can be deformed. Further, the flexible engage arm 9 is formed with an engage end surface 21, a reverse insertion preventing projection portion 13 at a free end thereof, and a reverse insertion preventing block portion 15. These reverse insertion preventing projection and block portions 13 and 15, respectively, have terminal contact surface portions 13*a* and 1S*a*, respectively, an end 7*a* of the terminal part 7 being brought into contact with each portion 13*a* and 15*a* when the terminal part 7 is inserted into the connector housing 3 in the reverse direction.

On the other hand, the terminal part 7 is roughly formed with a wire clamping portion 17 and a fiat electric contact portion 19. The fiat electric contact portion 19 is formed by bending a plate into a flat cylindrical shape in such a way as to fit into the inner wall of the connector housing 3.

When the terminal part 7 is inserted into the terminal accommodating chamber 5 normally (in the normal direction), as shown in FIG. 2, since the engage end surface 21 of the flexible engage arm 9 is engaged with an engage shoulder portion 23 of the terminal part 7, the terminal part 7 can be accommodated and held in position within the terminal accommodating chamber 5 of the connector housing 3.

In contrast with this, when the terminal part 7 is inserted into the terminal accommodating chamber 5 abnormally (in the reverse direction) as shown in FIG. 3, since an end portion 7*a* of the terminal part 7 is brought into contact with the terminal contact surface portion 15*a* of the reverse insertion preventing block portion 15, it is possible to prevent the terminal part 7 from being inserted into the connector housing 3 in the reverse direction. In addition, in case the terminal part 7 inserted in the reverse direction is inserted forcibly beyond the reverse insertion preventing block portion 15 as shown in FIG. 3B, since the end portion 7*a* of the terminal part 7 is further brought into contact with the terminal contact surface portion 13*a* of the reverse insertion preventing projection portion 13, it is possible to prevent the terminal part 7 from being inserted into the connector housing 3 in the reverse direction. In other words, the terminal part 7 can be doubly prevented from being inserted into the connector housing 3 in the reverse direction securely.

In the above-mentioned prior art reverse insertion preventing connector 1, however, since the reverse insertion preventing block portion 15 is formed at the base portion of the flexible engage arm 9 and thereby the wall thickness of this block portion 15 is relatively large, there exists a problem in that the flexibility of the engage arm 9 is insufficient and therefore the engage arm 9 is easily damaged when deformed excessively.

In addition, since the contact portion 15*a* of the engage arm 9 is formed on the insertion side of the terminal part 7, even when the terminal part 7 is inserted into the terminal accommodating chamber 5 in the normal direction, the end portion 7*a* of the terminal part 7 tends to be brought into contact with or caught by the contact portion 15*a* of the engage arm 9, thus causing another problem in that the terminal part 7 cannot be inserted smoothly into the terminal accommodating chamber 5.

SUMMARY OF THE INVENTION

With these problems in mind, therefore, it is the object of the present invention to provide a reverse insertion preventing connector by which the terminal part can be inserted into the terminal accommodating chamber smoothly without being damaged even if the flexible engage arm is deformed excessively.

To achieve the above-mentioned object, the present invention provides a reverse insertion preventing connector, comprising: a terminal part (29); and a connector housing (25) formed with a flexible engage arm (31) having an arm portion (37) extending from an inner wall (33) thereof, an arm end engage step portion (43) engaged with said terminal part (29) when said terminal part has been inserted into said connector housing (25) in a normal direction, and an arm end projection portion (47) engaged with said terminal part (29) when said terminal part is being inserted into the connector housing (25) in a reverse direction; wherein said connector housing (25) is further formed with at least one terminal insertion guide slope portion (51) extending from the inner wall (33) thereof to such a position as to be roughly flush with the arm end projection portion (47) beside the flexible engage arm (31) to guide said terminal part (29) inserted into said connector housing (25).

Further, the present invention provides a reverse insertion preventing connector, comprising: a terminal part (29) formed with a wire clamping portion (55) and a flat electric contact portion (57) having a free end portion (29*a*), an engaging projection (59) and a reverse insertion preventing convex portion (61); and a connector housing (25) formed with a flexible engage arm (31) having an arm portion (37) extending from an inner wall (33) of a terminal part accommodating chamber (27) thereof along a terminal part insertion direction, and an arm end projection portion (47) engaged with the engaging projection (59) of said terminal part (29) when said terminal part has been inserted into said connector housing (25) in a normal direction and further engaged with the reverse insertion prevention convex portion (61) of said terminal part (29) when said terminal part is being inserted into the connector housing (25) in a reverse direction, said connector housing (25) being further formed with at least one side wall portion (50) having a terminal insertion guide slope portion (51) extending from the inner wall (33) thereof in the terminal part insertion direction to such a position as to be roughly flush with the arm end projection portion (47) in the vicinity of the flexible engage arm (31) to guide said terminal part (29) inserted into said connector housing (25).

Further, it is preferable that the terminal insertion guide slope portions (51) are formed on both sides of the flexible engage arm (31), respectively. Further, it is preferable that said connector housing (25) is further formed with another small terminal guide slope portion (39) extending from the inner wall (33) to a fixed end of the arm portion (37) of the flexible engage arm (31) for providing a further easy insertion of said terminal part into said connector housing.

Further, said arm end projection portion (47) is formed with an arm end engage step portion (43) engaged with the engaging projection (59) of said terminal part (29) when said terminal part has been inserted into said connector housing (25) in a normal direction securely, and further with a reverse insertion prevention engage surface portion (49) engaged with a reverse insertion prevention convex portion (61) of said terminal part (29) when said terminal part is being inserted into the connector housing (25) in a reverse direction.

In the reverse insertion preventing connector according to the present invention, when the terminal part is inserted into the connector housing in the normal direction, since the free end portion of the terminal part is brought into contact with the terminal insertion guide slope portion, it is possible to securely guide the terminal part into the connector housing to the flexible engage arm. When the terminal part is further inserted deep into the connector housing, since the free end portion of the terminal part is engaged with the engage step portion of the flexible engage arm, the terminal part can be accommodated in position within the connector housing. In this case, since the free end of the terminal part is guided along the terminal insertion guide slope portion, it is possible to smoothly insert the terminal part into the connector housing.

Further, when the terminal part is inserted into the connector housing in the reverse direction, since the free end or the reverse insertion preventing convex portion of the terminal part is brought into contact with the arm end projection portion of the flexible engage arm, it is possible to securely prevent the terminal part from being further inserted into the connector housing in the reverse direction.

In comparison with the prior art reverse insertion preventing connector, since no reverse insertion preventing block portion is formed at the base portion of the flexible engage arm, even if the flexible engage arm is deformed excessively, the flexible engage arm is not easily damaged.

Further, when the terminal insertion guide slope portion is formed on both sides of the flexible engage arm, respectively, even if the terminal part is inserted into the connector housing obliquely, it is possible to guide the terminal part into the connector housing smoothly and securely.

BRIEF DESCRIPTION OF THE DRAWINGS

FIGS. 5(A) to 5(D) are cross-sectional views showing the steps of normal insertion of the terminal part into the terminal accommodating chamber of the reverse insertion preventing connector according to the present invention, in which FIG. 5(A) shows the state where the terminal part is not yet inserted into the terminal accommodating chamber; FIG. 5(B) shows the state where the free end portion of the terminal part is brought into contact with the terminal insertion guide slope; FIG. 5(C) shows the state where the free end portion of the terminal part is just introduced into the terminal insertion space; and FIG. 5(D) shows the state where the bent engage end portion of the terminal part is engaged with the engage step portion of the flexible engage arm;

FIGS. 6(A) to 6(D) are plan views showing the steps of normal insertion of the terminal part into the terminal accommodating chamber of the reverse insertion preventing connector according to the present invention, in which FIG. 6(A) shows the state where the terminal part is not yet inserted into the terminal accommodating chamber; FIG. 6(B) shows the state where the free end portion of the terminal part is brought into contact with the terminal insertion guide slope; FIG. 6(C) shows the state where the free end portion of the terminal part is just introduced into the terminal insertion space; and FIG. 6(D) shows the state where the bent engage end portion of the terminal part is engaged with the engage step portion of the flexible engage arm; and FIGS. 7(A) and (B) are cross-sectional views showing the steps of reverse insertion of the terminal part into the terminal accommodating chamber of the reverse insertion preventing connector according to the present invention, in which FIG. 7(A) shows the state where the terminal part is not yet inserted into the terminal accommodating chamber.

DETAILED DESCRIPTION OF THE EMBODIMENTS

An embodiment of the reverse insertion preventing connector according to the present invention will be described hereinbelow with reference to the attached drawings.

Figure 1:
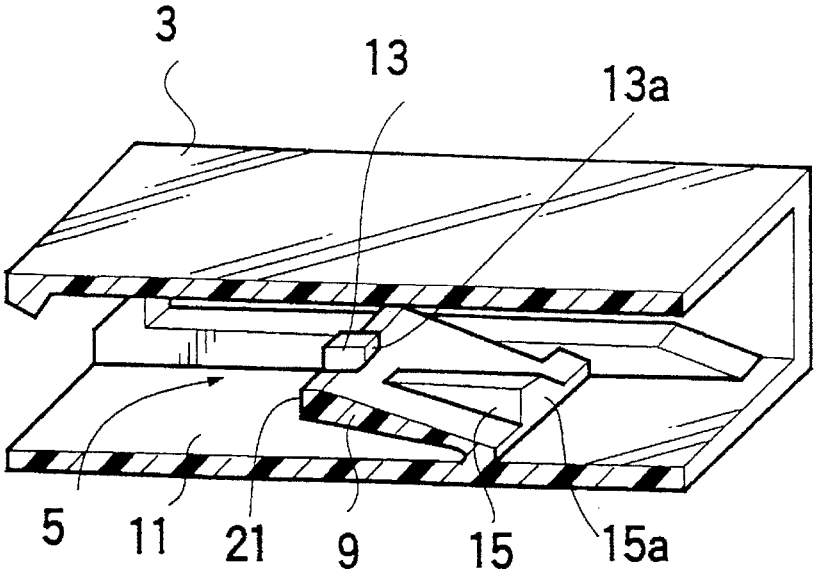
FIG. 1 PRIOR ART
FIG. 1 is a perspective, partially broken view showing a terminal accommodating chamber of a prior art reverse insertion preventing connector.
Figure 2:
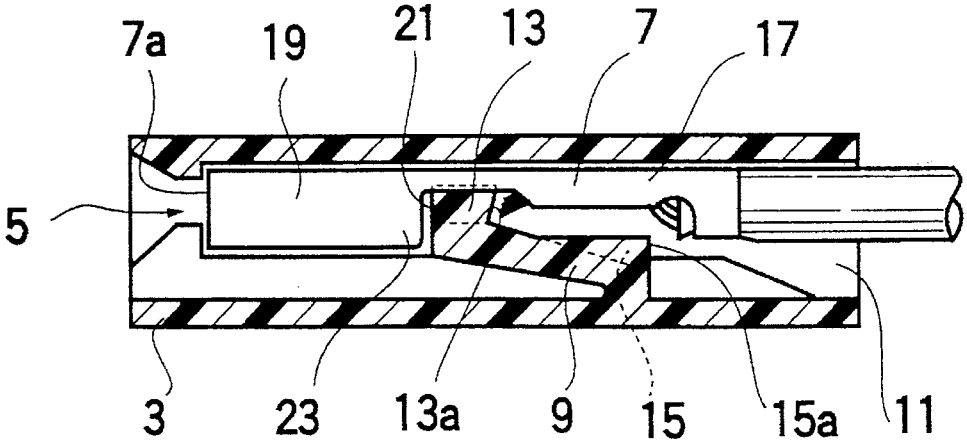
FIG. 2 PRIOR ART
FIG. 2 is a cross-sectional view showing the state where the terminal part is inserted into the prior art reverse insertion preventing connector in the normal direction.
Figure 3A:
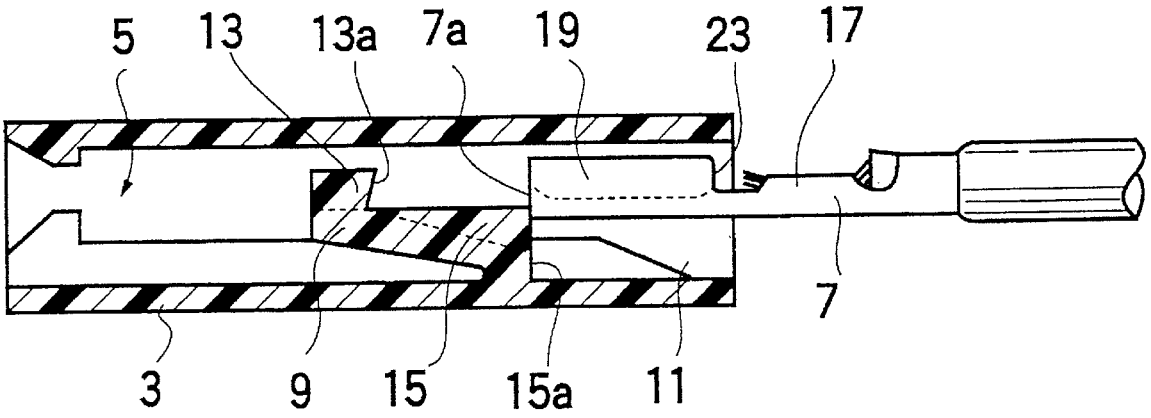
FIG. 3A PRIOR ART
FIG. 3A is a cross-sectional view showing the state where the terminal part is inserted into the prior art reverse insertion preventing connector in the reverse direction.
Figure 3B:
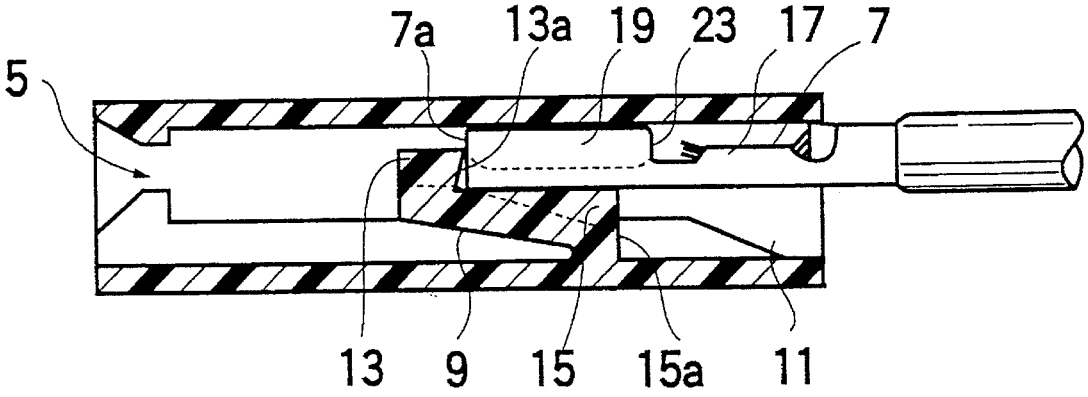
FIG. 3B PRIOR ART
FIG. 3B is another cross-sectional view showing the state where the terminal part is further inserted into the prior art reverse insertion preventing connector in the reverse direction.
Figure 4:
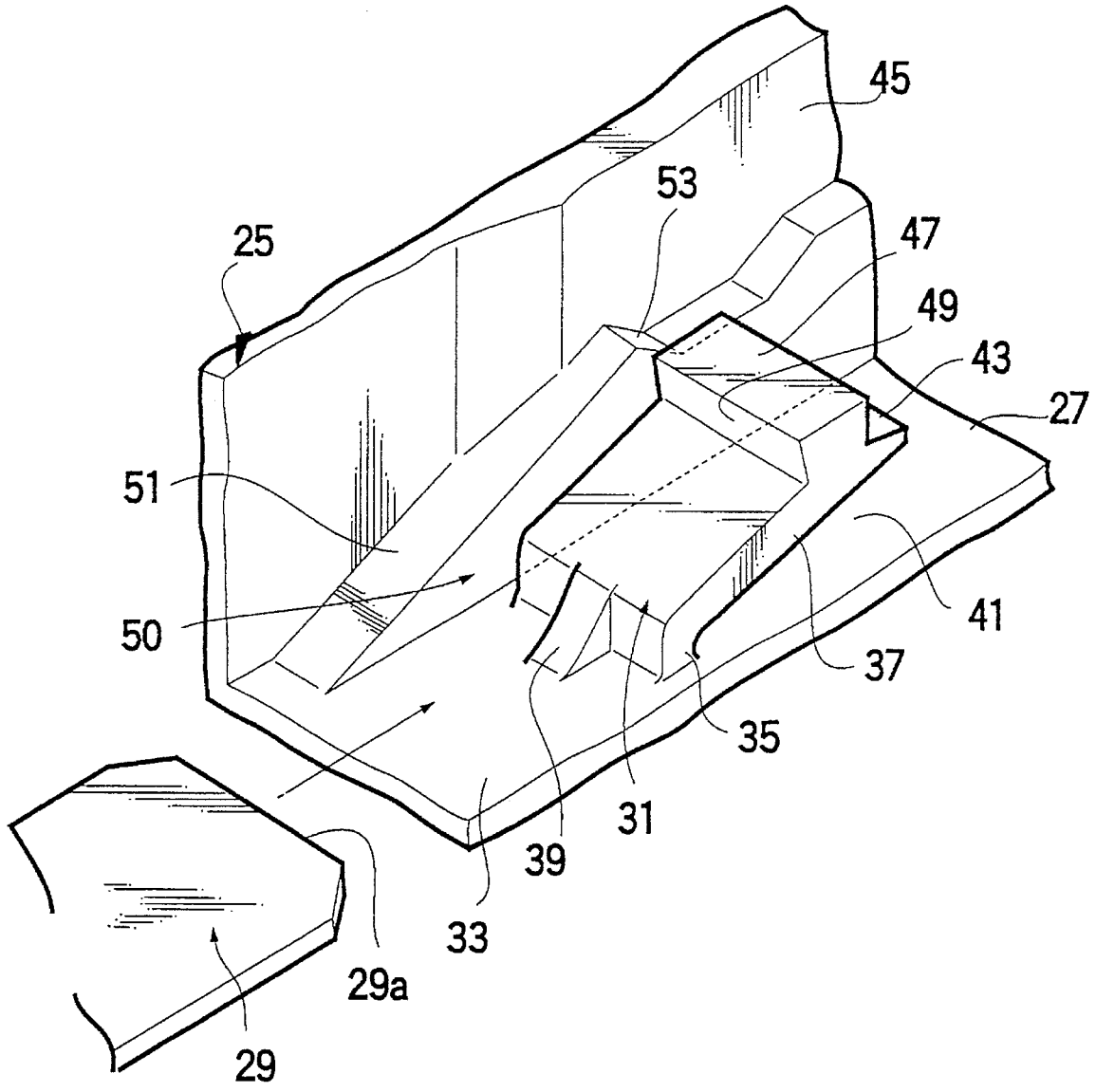
FIG. 4 is a perspective view showing an embodiment of the reverse insertion preventing connector according to the present invention.

As shown in FIG. 4, a flexible engage arm 31 is formed in a terminal accommodating chamber 27 of a connector housing 25. The flexible engage arm 31 is composed of a base portion 35 extending from an inner wall 33 of the connector housing 25 and an arm portion 37 extending from the base portion 35 in the terminal insertion direction (in the direction of arrow A in FIG. 4). Further, the base portion 35 is formed with a small terminal guide slope 39 at the middle (measured along the width) of the base portion 35.

Further, a space 41 is formed between the arm portion 37 and the inner wall 33 so that the arm portion 37 can be deformed freely when the terminal part 29 is inserted into the connector housing 25. Further, the arm portion 37 is formed with an arm end engage step portion 43 engaged with a bent engage end portion 59 (described later relative to FIGS. 5A–5D,) of the terminal part 29 and an arm end projection portion 47, both portions 43 and 47 facing toward a terminal insertion space 45 (on the opposite side to the space 41). The arm end projection portion 47 is formed over the entire width of the arm portion 37 so as to provide a reverse insertion preventing engage surface portion 49 on the side of the base portion 35.

In addition to the arm portion 37, the connector housing 25 is formed with a side wall portion 50 on the inner wall of the terminal accommodating chamber 27 and in the vicinity of the flexible engage arm 31. The side wall portion 50 is formed with a terminal insertion guide slope 51 on the inner surface of the side wall portion 50 along the terminal insertion direction. Here, it should be noted that the terminal insertion guide slope portion 51 is inclined inward from the inner wall 33 toward the arm end projection portion 47 so that a top portion 53 of the terminal insertion guide slope 51 is roughly flush with the inner surface of the arm end projection portion 47 of the flexible engage arm 35 extending from the inner wall 33 of the connector housing 25. Further, on the opposite side of the top portion 53 of the terminal insertion guide slope portion 51 (remote from the guide slope portion 51), the surface of the side wall portion 50 is inclined outward.

On the other hand, as shown in FIGS. 5A–5D and 6A–6D, the terminal part 29 of female type is formed with a wire clamping portion 55 for clamping an end of a wire W for electrical connection and a flat electric contact portion 57 electrically mated with a mated terminal part of female type. In addition, between the wire clamping portion 55 and the flat electric contact portion 57, a bent engage end portion 59 and a reverse insertion preventing convex portion 61 are formed on both sides of the terminal part 29. The bent engage end portion 59 of the terminal part 29 is engaged with the arm end engage step portion 43 of the flexible engage arm 35 when the terminal part 29 has been inserted into the connector housing 25 in the normal direction securely. The reverse insertion preventing convex portion 61 of the terminal part 29 is engaged with the reverse insertion preventing engage surface portion 49 of the reverse insertion preventing projection portion 47 when the terminal part 29 is being inserted into the connector housing 25 in the reverse direction.

The normal insertion steps of the terminal part into the connector housing will be described hereinbelow.

Figure 5A:
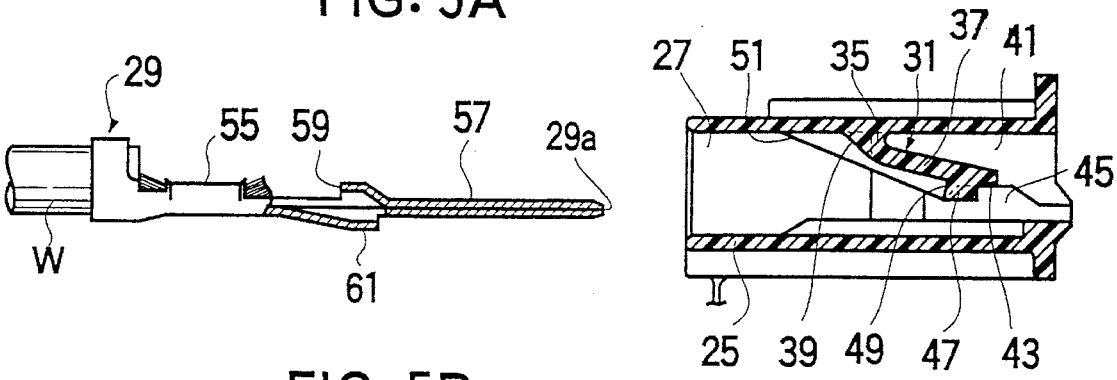
Figure 5B:
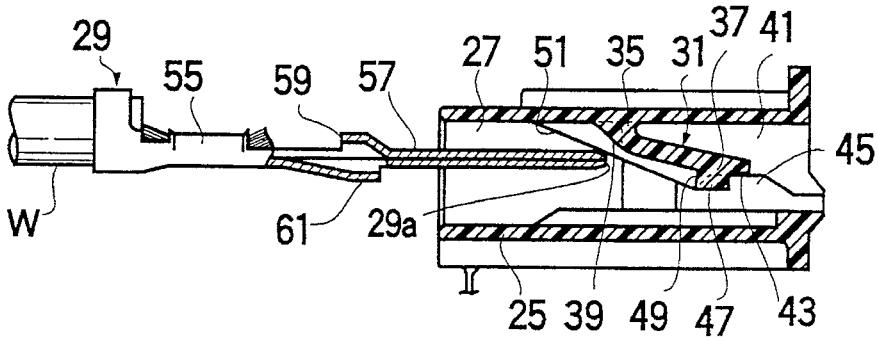
Figure 5C:
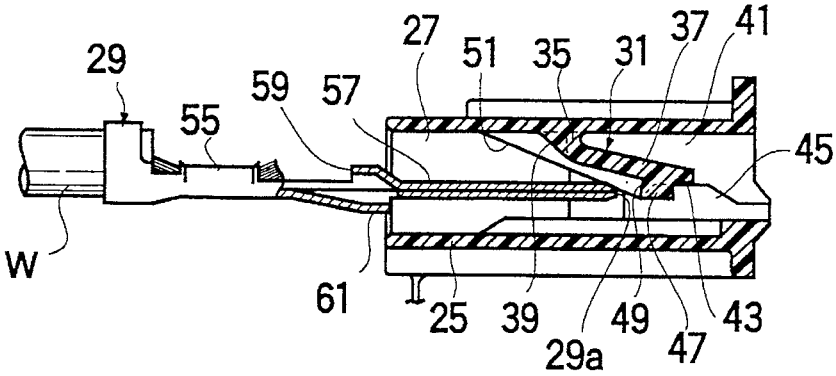
Figure 5D:
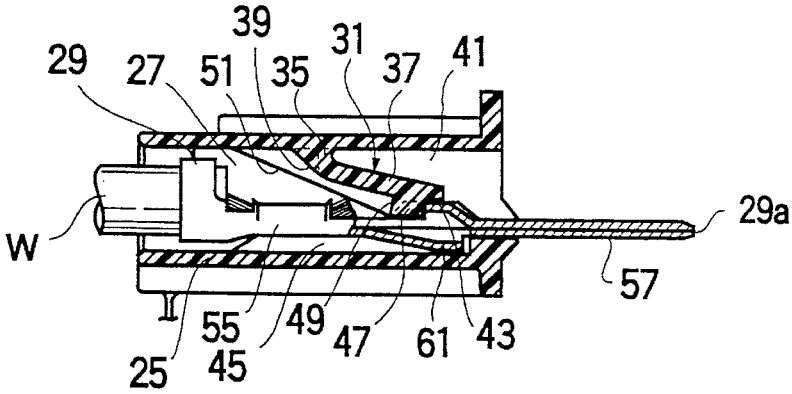
Figure 6A:
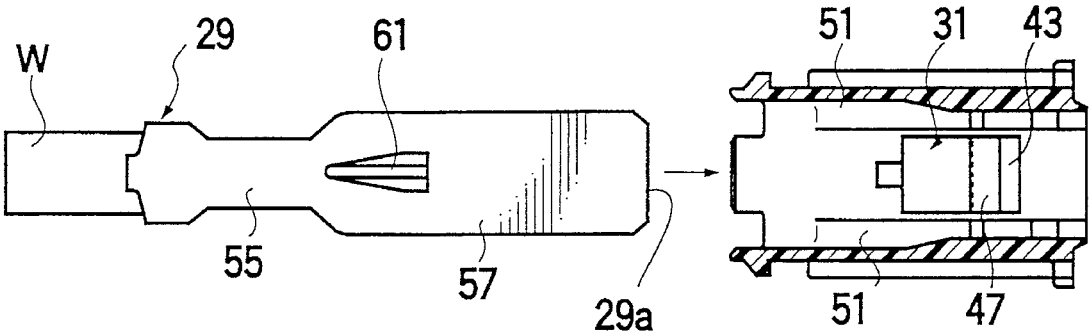
Figure 6B:
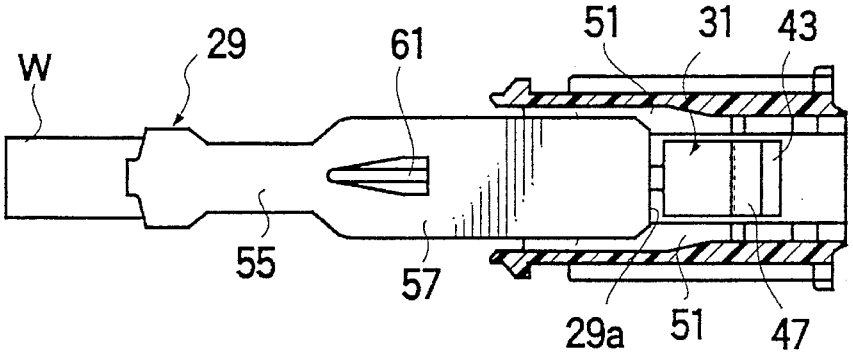
Figure 6C:
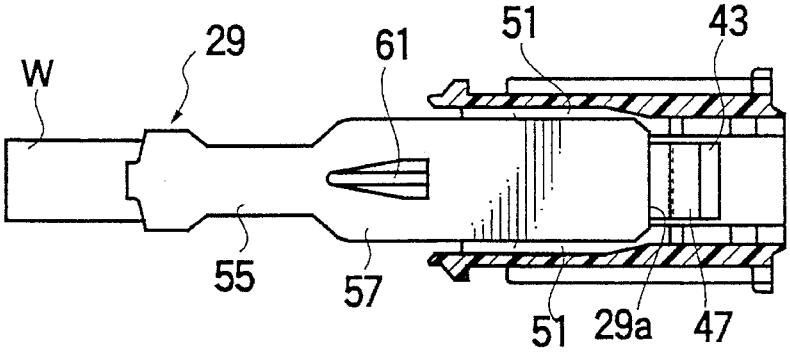
Figure 6D:
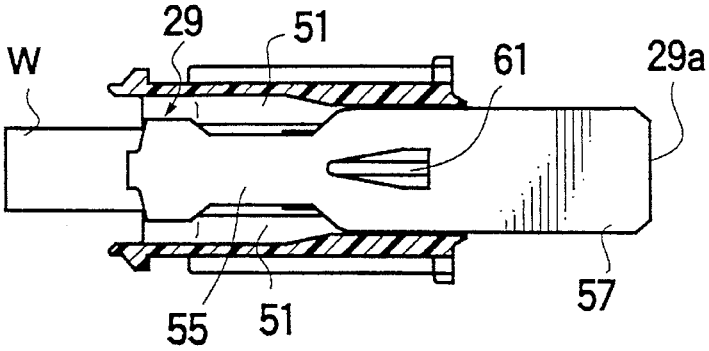

To insert the terminal part 29 into the terminal accommodating chamber 27 of the connector housing 25, after the terminal part 29 has been positioned in the normal direction relative to the terminal accommodating chamber 27 as shown in FIGS. 5(A) and 6(A), the terminal part 29 is inserted into the terminal accommodating chamber 27 as shown in FIGS. 5(B) and 6(B). When the terminal part 29 is being inserted into the terminal accommodating chamber 27, since the free end portion **29*a* of the flat electric contact portion 57 of the terminal part 29 is brought into contact with the terminal insertion guide slope portion 51 of the side wall portion 50, the terminal part 29 can be guided along the terminal insertion guide slope portion 51 and further inserted deep into the terminal insertion space 45 beyond the top portion 53 of the side wall portion 50 as shown in FIGS. 5(C) and 6(C). Further, when the terminal part 29 is further inserted deep into the terminal accommodating chamber 27, since the bent engage end portion 59 of the terminal part 29 is brought into contact with the arm end projection portion 47 of the flexible engage arm 31, the arm portion 37 is deformed toward the space 41. Further, when the bent engage end portion 59 of the terminal part 29 is inserted over the arm end projection portion 47 of the flexible engage arm 31, since the flexible engage arm 31 is restored to the original position by its own restoring force, the bent engage end portion 59 of the terminal part 29 is engaged with the arm end engage step portion 43 of the flexible engage arm 31, as shown in FIGS. 5(D) and 6(D). Accordingly, the terminal part 29 can be accommodated in position within the terminal accommodating chamber 27 of the connector housing 25**.

As described above, in the present invention, since the free end portion **29*a* of the terminal part 29 is inserted into the terminal accommodating chamber 27 of the connector housing 25 is guided by the terminal insertion guide slope portion 51 of the side wall portion 50, it is possible to improve the insertion workability of the terminal part 29 into the connector housing 25. In this insertion, since the small terminal guide slope portion 39 is further formed at the base portion 35 of the flexible engage arm 31, it is possible to guide and insert the free end portion 29*a* of the terminal part 29 more smoothly into the terminal insertion space 45 without contact with the base portion 35 of the flexible engage arm 31**.

Further, in the present invention, since no reverse insertion preventing block is formed in the base portion 35 of the flexible engage arm 31 (which is different from the prior art flexible engage arm), even if the flexible engage arm 31 is deformed excessively, the engage arm 31 will not be damaged. In other words, since no reverse insertion preventing block is provided at the base portion of the flexible engage arm 31, it is possible to determine the wall thickness of the base portion 35 of the flexible engage arm 31 appropriately, so that a sufficient elastic force of the flexible engage arm 31 can be obtained and thereby the flexible engage arm 31 can be prevented from being damaged due to excessive deformation.

Figure 7A:
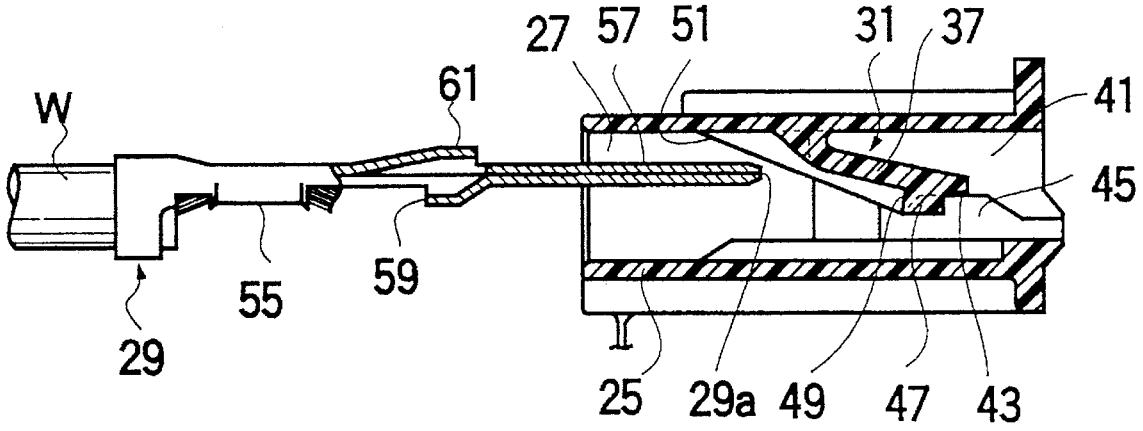
Figure 7B:
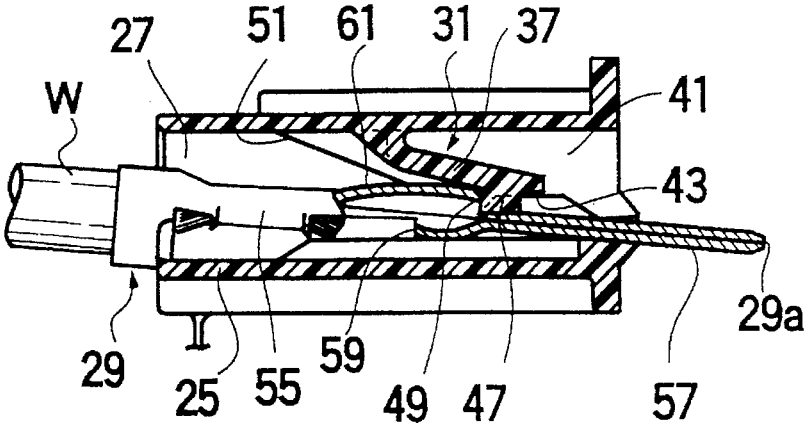
FIG. 7(B) shows the state where the terminal part is prevented from being further inserted into the terminal accommodating chamber in the reverse direction.

Further, when the terminal part 29 is inserted into the terminal accommodating chamber 27 in the reverse direction as shown in FIG. 7(A), since the free end portion **29*a* of the terminal part 29 is guided along the terminal insertion guide slope portion 51 of the side wall portion 50, the free end portion 29a of the terminal part 29 is introduced into the terminal insertion space 45. In this case, however, since the reverse insertion preventing convex portion 61 of the terminal part 29 is brought into contact with the reverse insertion engage surface portion 49 of the arm end projection portion 47 of the flexible engage arm 31, it is possible to securely prevent the terminal part 29 from being inserted deep into the terminal accommodating chamber 27 of the connector housing 25**.

Further, in the above-mentioned embodiment, the terminal insertion preventing guide slope portion 51 is formed only on one side of the flexible engage arm 31. Without being limited thereto, however, it is of course preferable to form the terminal insertion guide slope portion 51 on both sides of the flexible engage arm 31, respectively. In this case, since the terminal part 29 can be guided more securely into the terminal accommodating chamber 27 of the connector housing 25, it is possible to further improve the insertion workability of the terminal part 29 relative to into the connector housing 25. In this case, even if the terminal part 29 is inserted into the terminal accommodating chamber 27 of the connector housing 25 obliquely, it is possible to guide the terminal part 29 by use of either one of the terminal insertion guide slope portions 51.

As described above, in the reverse insertion preventing connector according to the present invention, since the connector housing 25 is formed with at least one side wall portion 50 having a terminal insertion guide slope portion 51 whose top portion 53 is roughly flush with the inner surface of the arm end projection portion 47 of the flexible engage arm 31, the terminal part 29 can be inserted into the terminal accommodating chamber 27 of the connector housing 25 smoothly owing to the guidance of the guide slop portion, thus improving the insertion workability of the terminal part relative to the connector housing.

What is claimed is:

1. A reverse insertion preventing connector, comprising a terminal part and a connector housing, said connector housing having an insertion end and another end defining an insertion direction therebetween, said connector housing comprising:

a flexible engagement arm having an arm portion extending from an inner wall of said connector housing in said insertion direction, an arm end projection portion disposed on said flexible engagement arm and engaged with said terminal part when terminal part is inserted into said connector housing in a reverse direction, an arm end engagement step portion extending from said flexible engagement arm on a side of said arm end projection portion, in said insertion, remote from said insertion end such that arm end engagement step portion is engaged with said terminal part when said terminal part is inserted into said connector housing in a normal direction and at least one terminal insertion guide slope portion formed beside said flexible engagement arm and extending from the inner wall toward said arm end projection portion, a top portion of said at least one terminal insertion guide slope portion being substantially level with said arm end projection portion, whereby said terminal part is guided by said terminal insertion guide slope portion as said terminal part is inserted into said connector housing.

2. The reverse insertion preventing connector of claim 1, wherein said at least one terminal insertion guide slope portion is formed on both sides of said flexible engagement arm.

3. The reverse insertion preventing connector of claim 1, wherein said connector housing comprises two terminal insertion guide slope portions, one of said terminal guide slope portions extending from the inner wall to a fixed end of an arm portion of said flexible engagement arm for providing a further easy insertion of said terminal part into said connector housing.

4. A reverse insertion preventing connector comprising a terminal part and a connector housing, said connector housing having an insertion end and another end defining a terminal part insertion direction therebetween said terminal part including a wire clamping portion and a flat electric contact portion, said flat electric contact portion including a free end portion, an engaging projection and a reverse insertion preventing convex portion;

said connector housing comprising:

a flexible engagement arm having an arm portion extending from an inner wall of a terminal part accommodating chamber along the terminal part insertion direction, an arm end projection portion disposed on said flexible engagement arm and engaged with said engaging projection of said terminal part when said terminal part is inserted into said connector housing in a normal direction, and further engaged with said reverse insertion preventing convex portion of said terminal part when said terminal part is inserted into said connector housing in a reverse direction, and at least one side wall portion having a terminal insertion guide slope portion formed beside said flexible engagement arm and extending from the inner wall toward said arm end projection portion, a top portion of said terminal insertion guide slope portion being substantially level with said arm end projection portion, whereby said terminal part is guided by said terminal insertion guide slope portion as said terminal part is inserted into said connector housing.

5. The reverse insertion preventing connector of claim 4, wherein said connector housing comprises another small terminal guide slope portion extending from the inner wall to a fixed end of said arm portion of said flexible engagement arm for providing a further easy insertion of said terminal part into said connector housing.

6. The reverse insertion preventing connector of claim 4, further comprising an arm end engagement step portion extending from said flexible engagement arm on a side of said arm end projection portion, in said terminal part insertion direction, remote from said insertion end such that said arm end engagement step portion engages with said engaging projection of said terminal part when said terminal part is inserted into said connector housing in a normal direction.

7. The reverse insertion preventing connector of claim 4, wherein said terminal insertion guide slope portion is formed on one side of said flexible engagement arm.

8. The reverse insertion preventing connector of claim 7, wherein said connector housing comprises an additional insertion guide slope portion formed on another side of said flexible engagement arm.

* * * * *